US007435036B2

(12) United States Patent
Cullen

(10) Patent No.: US 7,435,036 B2
(45) Date of Patent: Oct. 14, 2008

(54) FLEXIBLE WATER GATE

(75) Inventor: Martin Cullen, Glasgow (GB)

(73) Assignee: University Court of Glasgow, Caledonian University, Glasgow, Scotland (GB)

( * ) Notice: Subject to any disclaimer, the term of this patent is extended or adjusted under 35 U.S.C. 154(b) by 0 days.

(21) Appl. No.: 10/497,957

(22) PCT Filed: Dec. 9, 2002

(86) PCT No.: PCT/GB02/05579

§ 371 (c)(1),
(2), (4) Date: Apr. 8, 2005

(87) PCT Pub. No.: WO03/054306

PCT Pub. Date: Jul. 3, 2003

(65) Prior Publication Data

US 2005/0163570 A1 Jul. 28, 2005

(30) Foreign Application Priority Data

Dec. 8, 2001 (GB) ..... 0129435.4

(51) Int. Cl.
*E02B 7/20* (2006.01)

(52) U.S. Cl. ..... 405/91; 405/106; 405/115

(58) Field of Classification Search ..... 405/21, 405/26, 60, 62, 63–69, 87, 91, 98, 103–107, 405/115, 113
See application file for complete search history.

(56) References Cited

U.S. PATENT DOCUMENTS 1,067,242 A * 7/1913 Gillette ..... 405/85
1,810,449 A * 6/1931 Hisakichi ..... 405/87
1,868,147 A * 7/1932 Kruse ..... 251/172
2,593,969 A 4/1952 Bowtell
2,889,684 A * 6/1959 Abrahams ..... 405/106

(Continued)

FOREIGN PATENT DOCUMENTS

DE 718164 3/1942

(Continued)

OTHER PUBLICATIONS

Patent Cooperation Treaty (PCT); International Search Report (PCT Article 18 and Rules 43 and 44); International Application No. PCT/GB02/05579; International Filing Date: Dec. 9, 2002; Applicant: University Court of Glasgow Caledonian University, undated.

(Continued)

*Primary Examiner*—Sunil Singh
(74) *Attorney, Agent, or Firm*—K&L Gates LLP

(57) ABSTRACT

A flexible water gate is described that is suitable for retaining water in a port, canal or river estuary. The gate is both economical to build and maintain and comprises a gate controller that allows a flexible member to be controllably moved between a closed and open position, as required. A flexible flood control barrier that comprises one or more of the aforementioned flexible water gates is also described. These gates are deployed side to side and provide an economical way of providing flood protection to an area susceptible to flood tides. When not in use the flexible membranes of the flexible water gates can be stored on the riverbed so permitting unrestricted access for marine vessels.

6 Claims, 4 Drawing Sheets

U.S. PATENT DOCUMENTS

| | | | | | |
|---|---|---|---|---|---|
| 2,984,074 | A | * | 5/1961 | Le Clair et al. | 405/106 |
| 4,484,836 | A | | 11/1984 | Bailard | |
| 4,662,783 | A | | 5/1987 | Muramatsu et al. | |
| 4,787,774 | A | * | 11/1988 | Grove | 405/94 |
| 5,154,537 | A | | 10/1992 | DeVries et al. | |
| 5,460,462 | A | * | 10/1995 | Regan | 405/96 |
| 7,121,764 | B2 | * | 10/2006 | Rorheim | 405/107 |
| 2003/0167696 | A1 | * | 9/2003 | Chen | 49/477.1 |

FOREIGN PATENT DOCUMENTS

| | | | |
|---|---|---|---|
| WO | WO9000649 | * | 1/1990 |
| WO | 0356362 | * | 2/1990 |

OTHER PUBLICATIONS

English translation of German Patent No. DE718164, undated.

* cited by examiner

FLEXIBLE WATER GATE

CROSS-REFERENCE TO RELATED APPLICATIONS

This application is the national phase of International (PCT) Patent Application Serial No. PCT/GB02/05579, filed Dec. 9, 2002, published under PCT Article 21(2) in English, which claims priority to and the benefit of British Patent Application No. 0129435.4, filed Dec. 8, 2001, the disclosures of which are incorporated herein by reference.

FIELD OF THE INVENTION

The present invention relates to the field of water gates. In particular, it relates to a water gate made from a flexible membrane for use within a port, canal or river estuary.

BACKGROUND OF THE INVENTION

Water gates are employed in a range of impound docks, marinas and canals in order to protect vessels from the detrimental effects of tides, wind and waves. Similarly such gates are employed within lock mechanisms so as to permit vessels to move up and down from one water level to another within a canal.

A further area where water gates are employed is in the construction of flood control barriers. Typically, a number of gates are located across a river estuary and are deployed at times when tide levels rise to such a point that there is a significant danger of flooding of the surrounding area.

In order for existing flood control barriers designs to provide the necessary protection their construction requires substantial civil engineering work that includes the installation of concrete caissons. A good example of such a flood control barrier is the Thames Barrier. Such structures are therefore extremely expensive and their installation can seriously disturb the habitat of the sub-sea life forms and the surrounding environment.

The Prior Art teaches of Mitre, Sector, Radial and Flap style water gates employed for the aforementioned purposes. These all comprise steel core structures with various means for providing the required watertight seal. However, for various reasons these gate designs are prone to leakage.

In the UK alone 73% of ports that employ Mitre gates exhibit substantial levels of leakage. Such leaks cost time and the associated water losses can render the port unattractive and ultimately inoperable. Replacement gates cost in the region of .English Pound.800,000 and have a lifetime of about 30 to 50 years. However, Mitre gates require major maintenance work every 10 to 15 years that typically incurs costs of .English Pound.200,000.

In addition the effects of global warming are reducing the efficiency of Mitre gates due to increases in the associated water levels. These gates depend upon hydraulic pressure that results from the difference in the water levels from the upper side and lower side of the Mitre gate. Such increased water levels act to reduce this difference hence reducing the gate efficiency.

A second disadvantage of such gate designs is the fact that they employ hardwoods in order to provide the required watertight seals. These woods are expensive due to their limited supply and so a more environmentally friendly solution would be preferable.

Presently, Sector gates are the preferred option for replacing Mitre Gates. Although the gates themselves offer an economical alternative to the Mitre Gate they require extensive civil engineering work to be carried out to provide the required Sector gate recesses. Such civil engineering is both time consuming and expensive incurring costs of several millions of pounds.

BRIEF SUMMARY OF THE INVENTION

It is an object of the present invention to provide a flexible water gate suitable for retaining water in a port, canal or river estuary that is economical to build and maintain while providing a controllable means for deploying the gate when required.

It is a further object of the present invention to provide a flexible flood control barrier comprising one or more flexible water gates that can be controllably deployed at times when tide levels rise to produce an imminent risk of flooding of the surrounding area.

According to a first aspect of the present invention there is provided a flexible water gate for retaining water in a port, a canal or river estuary comprising a flexible membrane and a gate operating mechanism, wherein the gate operating mechanism moves the flexible water gate between a closed position and an open position.

Preferably the flexible water gate further comprises a plurality of support lines.

Preferably the support lines are selected from the group comprising rope, chains, cord, straps or other suitable material capable of providing the required tensile strength.

Preferably the flexible membrane comprises Nylon. Alternatively the flexible membrane comprises Polyester, although any other impermeable flexible material may be employed.

Optionally the gate operating mechanism comprises a mechanical pulley system.

Alternatively the gate operating system comprises an inflatable chamber connected to the flexible membrane and a pressurised gas control means.

Preferably the flexible water gate further comprises a plurality of adjustment means, wherein the adjustment means connect the support lines and the mechanical pulley system.

Most preferably the support lines are connected to the mechanical pulley system in a substantially vertical plane, wherein when the mechanical pulley system moves the support lines downwards within the said substantially vertical plane the flexible water gate moves from the closed position to the open position.

Preferably the adjustment means comprises a turn buckle adjustment screw wherein the turn buckle adjustment screw allows the tension within the support lines to be varied.

Preferably the mechanical pulley system is housed within recesses located on either side of the flexible membrane.

Preferably the flexible water gate further comprises a side seal associated with each recess.

Preferably the flexible water gate further comprises a step associated with a canal, port or river bed on which is located a bottom seal, a support means, a clamp and a fixing means wherein the support means, clamp and fixing means act to secure the bottom edge of the flexible membrane.

Most preferably the hydraulic pressure associated with the retained water acts to maintain the flexible membrane against the side seals and the bottom seal so rendering the flexible water gate watertight.

Preferably the mechanical pulley system comprises two or more support frames, a chain and a plurality of pulley wheels, wherein the chain and pulley wheels are arranged such that the chain provides at least two substantially vertical sections such that the sections of the chain that fall within these vertical sections travel with the same velocity.

Preferably the support frames comprise a vertical post a plurality of rollers wherein the rollers are free to move along the length of the vertical post.

Preferably the support frame further comprises one or more support guys, and one or more pile foundations, wherein the support guys connect the pile foundations to the vertical post.

Preferably the chain and the adjustable buckle screws are connected to the rollers.

Preferably the mechanical pulley system is driven by an electric motor.

Preferably the gate operating system further comprises a buoy and a buoy anchoring means associated with either side of the flexible membrane.

Preferably the flexible membrane is connected to a buoy anchoring means via a plurality of eye connectors.

Preferably the flexible water gate further comprises a support means, a clamp and a fixing means wherein the support means, clamp and fixing means secure the bottom edge of the flexible membrane.

Most preferably the pressurised gas control means acts to inflate and deflate the inflatable chamber with a gas so causing the flexible water gate to move between the closed and open positions, respectively.

Preferably the gas is selected from a group consisting of the following air, oxygen, nitrogen and carbon dioxide.

According to a second aspect of the present invention there is provided a flexible flood control barrier comprising two or more flexible water gates in accordance with the first aspect of the present invention wherein the flexible water gates are deployed so as to be located side by side and operate independently as required during periods of flood tides.

BRIEF DESCRIPTION OF THE DRAWINGS

Embodiments of the present invention will now be described by way of example only with reference to the accompanying figures, in which:

FIG. 5 presents a:

(a) side view, with equal water levels, of an alternative flexible water gate;

(b) side view, with flood water levels, of the alternative flexible water gate; and (c) perspective view of flood control barrier comprising two alternative flexible water gates, in accordance with an aspect of the present invention.

DETAILED DESCRIPTION OF THE INVENTION

Figure 1:
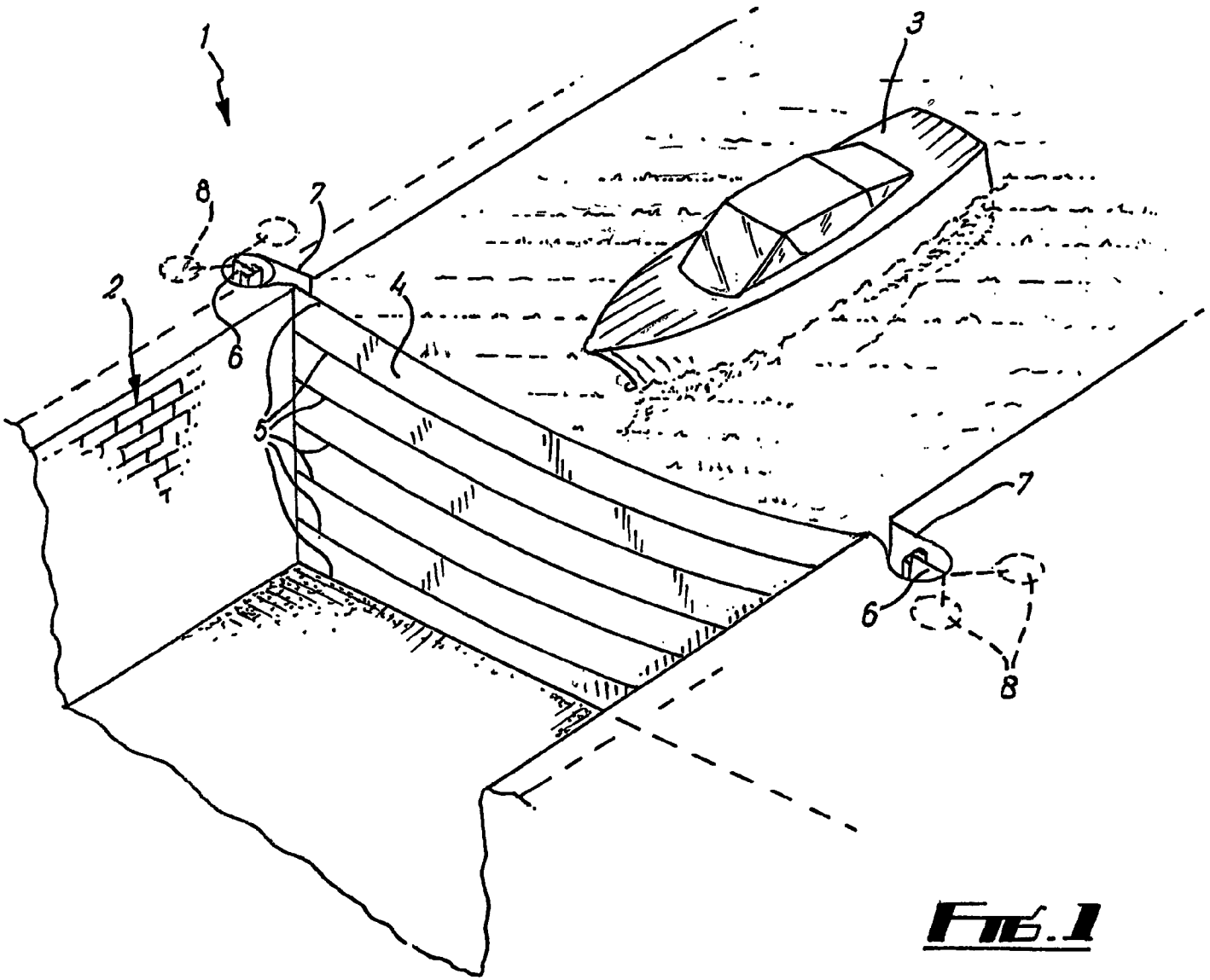
FIG. 1 presents a schematic illustration of a flexible water gate in accordance with an aspect of the present invention.

FIG. 1 presents a schematic illustration of a flexible water gate 1 incorporated with a canal system 2 containing a vessel 3. The flexible water gate 1 can be seen to comprise a flexible membrane 4 made from either Nylon or Polyester, a plurality of gate ropes 5, two support frames 6 each housed within a support frame recess 7 and two pile foundations 8 associated with each support frame 6.

Figure 2:
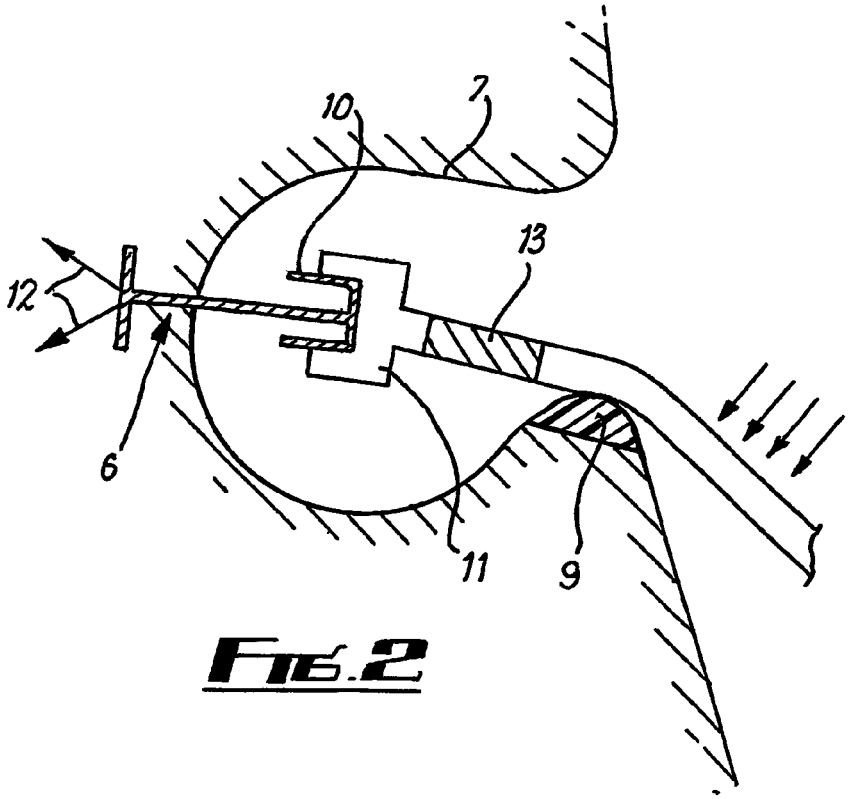
FIG. 2 presents a plan elevation of the support frame and the foundations employed by the flexible water gate of FIG. 1.

Further detail of the support frames 6 and support frame recesses 7 is presented in FIG. 2. The support frame recess 7 comprises a Neoprene seal 9 located on the low water side of the flexible water gate 1.

The support frame 6 comprises a vertical post 10, a plurality of rollers 11 mounted on the vertical post 10, two support guys 12 and a plurality of turn buckle adjustment screws 13. The flexible water gate 1 is attached to the support frame 6 via the gate ropes 5. A particular gate rope 5 connects to one end of a turn buckle adjustment screw 13. The opposite end of the turn buckle adjustment screw 13 is thereafter connected to a roller 11.

By tightening the turn buckle adjustment screw 13 tension is applied to the flexible water gate 1. The hydraulic pressure associated with the retained water causes the flexible membrane 4 to press against the Neoprene seal 9 so forming the required watertight seal along the sides of the flexible water gate 1.

In an alternative embodiment a support strut (not shown) may be deployed between the support frame recess 7 and the flexible membrane 4, on the retained water side of the flexible water gate 1. The addition of such a support strut improves the efficiency of the Neoprene seal 9 particularly in times of increased water levels on the low water side of the flexible water gate 1.

Figure 3:
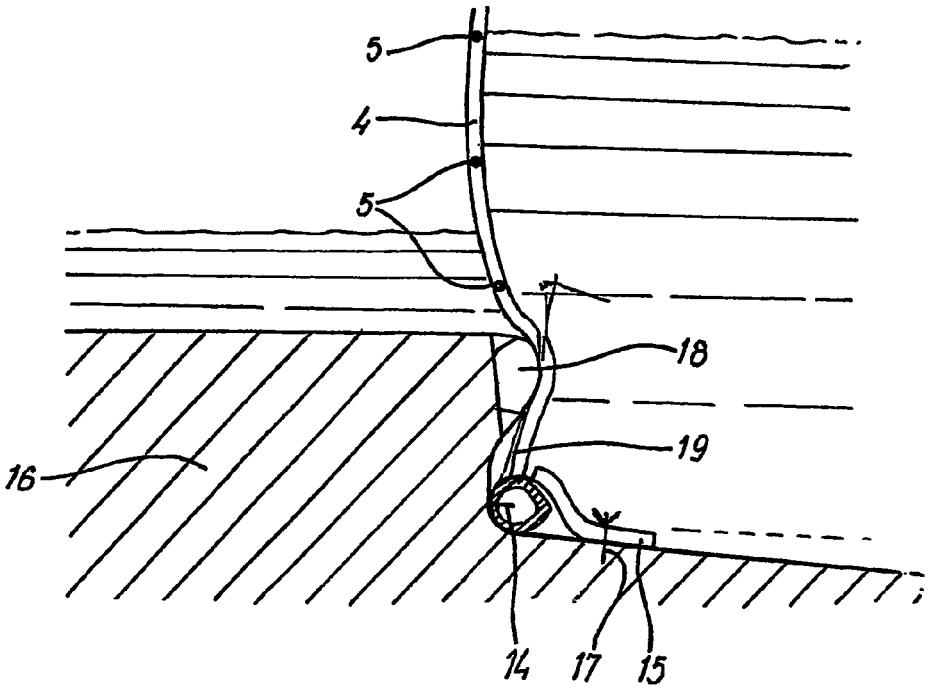
FIG. 3 presents a side elevation of a seal for the lower side of the flexible water gate of FIG. 1.

FIG. 3 presents the means for providing the watertight seal along the bottom of the flexible water gate 1. The lower side of the flexible membrane 4 is attached to a support tube 14. The support tube 14 is then held in place by a clamp 15 that is fixed to the canal floor 16 by a fixing pile 17. A further Neoprene seal 18, incorporated within a step 19 engineered on the canal floor 16, then provides the required watertight seal in a similar fashion to that described above. Hydraulic pressure associated with the retained water causes the flexible membrane 4 to press against the Neoprene seal 18 so forming the required watertight seal along the bottom of the flexible water gate 1.

Figure 4:
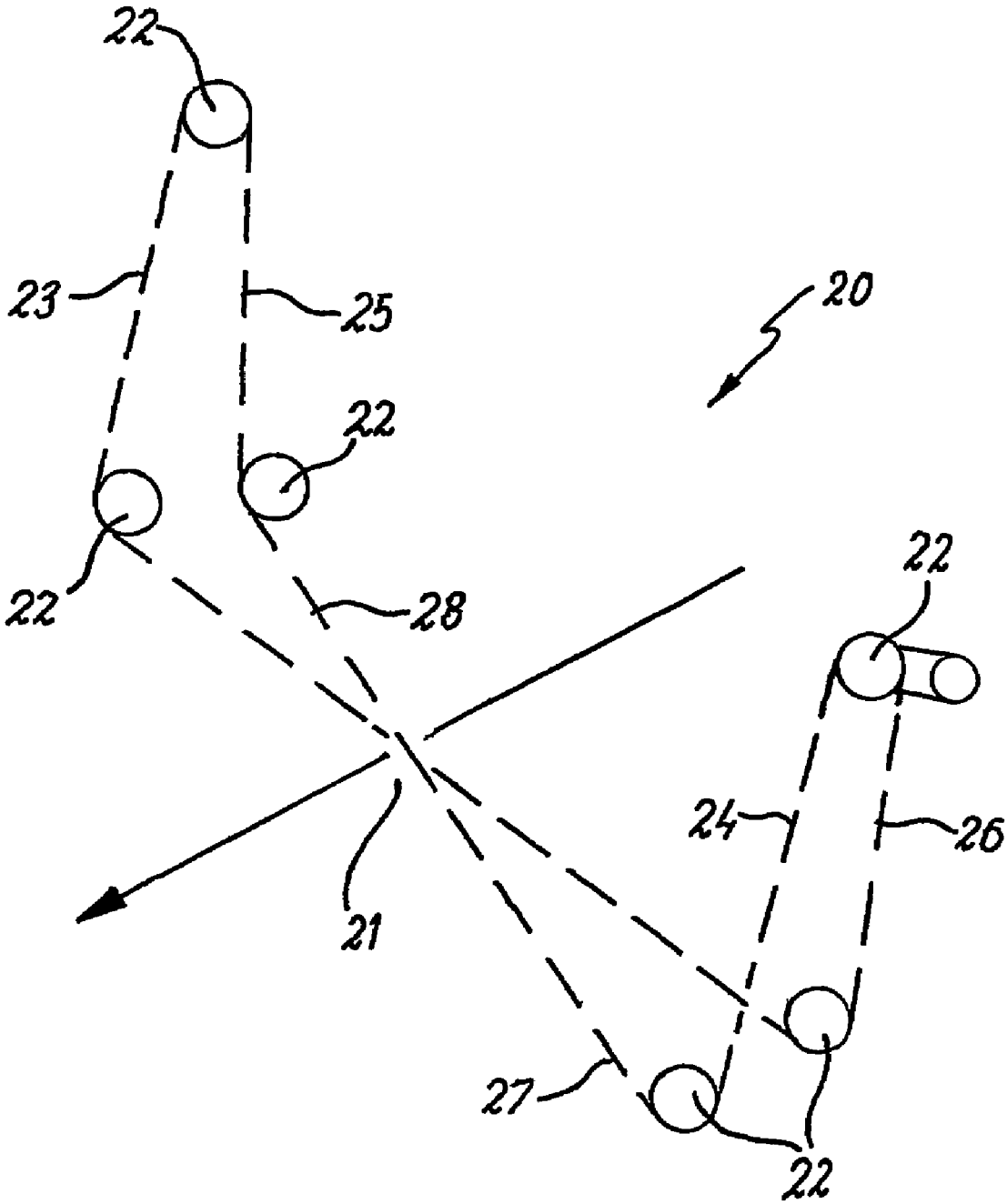
FIG. 4 presents a schematic illustration of a pulley mechanism employed to operate the flexible water gate of FIG. 1.

The flexible water gate 1 moves between a closed and open position under the action of an electric motor driven pulley system 20 shown schematically in FIG. 4. The pulley system 20 comprises a continuous chain 21 that interacts with six pulley wheels 22 so as to provide four vertical sections 23, 24, 25 and 26, and two horizontal sections 27 and 28 that cross over on the canal floor 16. The orientation of the vertical sections 23 and 24 are such that they move in the same sense, either both up or both down. Similarly the vertical sections 25 and 26 are so inter related.

By attaching the rollers to either vertical sections 23 and 24 or vertical sections 25 and 26 of the chain 21' allows for the flexible water gate 1 to be moved between the closed and open position under the control of the electric motor, as appropriate. As the flexible water gate 1 moves towards the open position the retained water is released so allowing the water levels on either side of the flexible water gate 1 to equalise.

Figure 5A:
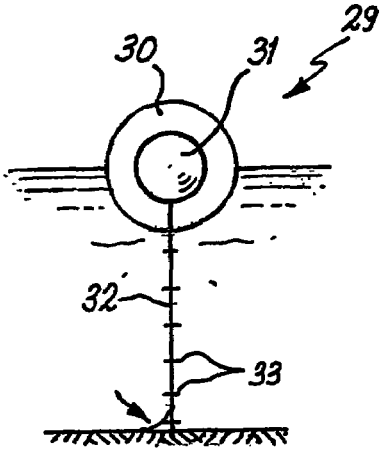
Figure 5B:
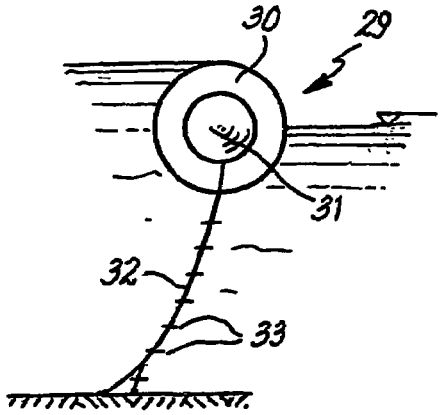
Figure 5C:
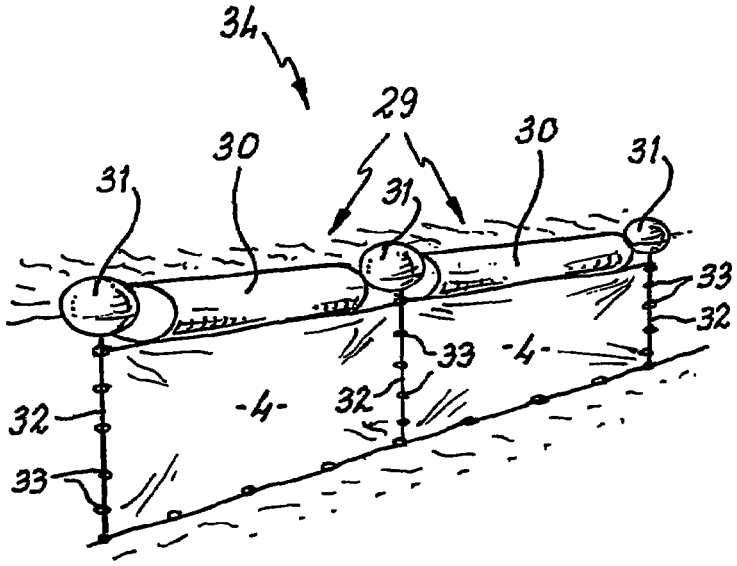

FIG. 5 presents an alternative embodiment of the flexible water gate 29. In particular FIG. 5(*a*) presents a side view of a single flexible water gate 29, with equal water levels on alternative sides of the gate 29. FIG. 5(*b*) presents a side view of the single flexible water gate 29 during a flood water situation such that the water levels on alternative sides of the gate 29 are no longer equal.

The flexible water gate 29 can be seen to comprise a flexible membrane 4, an air chamber 30, buoys 31 located at either side of the flexible membrane 4 and an anchor cable 32 associated with each buoy 31. The flexible membrane 4 is attached at either end to an anchor cable 32 via a plurality of eye connectors 33.

In this particular embodiment the operation of the flexible water gate 29 depends on the upper edge being buoyant therefore pulling the flexible membrane 4 tight. To engage the flexible water gate 29, air is pumped into the air chamber 30 so as to create a positive uplift on the gate 29. Similarly to disengage the flexible water gate 29 the pressurised air within the air chamber 30 is released allowing the structure to sink to the seabed.

As the outer water level increases the differing hydrostatic forces will cause the flexible membrane 4 to lean towards the coastline as shown in FIG. 5(*b*). However, as the length of the flexible membrane 4 does not change significantly the buoyant air chamber 30 is pulled downwards. This downwards motion acts to increase the upward force so tending to pull the flexible membrane 4 back from its leaning position. Equilibrium is then established between the difference in head of water and the increased buoyancy, thereby providing stability to the flexible water gate 29.

The flexible water gate 29 is particularly suited to helping in address the potential flooding of coastal areas. By arranging two or more flexible water gate 29 end to end a flexible flood control barrier 34 can be constructed, as presented in a perspective view in FIG. 5(*c*).

The flexible flood control barrier 34 is not intended to be watertight as there will be leakage between individual flexible water gates 29. However, the effects of such leakage is of reduced significance due to the fact that the tidal water levels are time dependant and will therefore eventually reduce with the ebbing tide.

Although the flexible flood control barrier 34 is located in position at all times, during normal tide conditions the location will only be evident by the presence of the buoys 31 anchored to the river bed. As the flexible membranes 4 are connected to associated anchoring cables the position of each individual flexible water gate 1 can be independently controlled. When not required the flexible membranes can all be moved to their relevant storage positions on the river bed.

The presence of the buoyant air chambers 30 within the flexible flood control barrier 34 provides an added advantage for such a system in that as this design is flexible it provides an energy absorbing physical barrier to the wave action and any floating debris.

Aspects of the present invention have the advantage that they provide a flexible water gate for use in a port, canal or river estuary that is both economical to build and install as well as providing a watertight barrier. By employing a non-biodegradable flexible membrane the need for subsequent maintenance is reduced, while the overall lifetime of the gate is increased, as compared to those previously described in the Prior Art.

The flexible water gate also has the further advantage that it is light and compact and so is easy to transport over long distances and so easier to deploy in areas with poor accessibility.

A yet further advantage of the flexible water gate is that it does not require the same engineering skill levels as required for the installation of the other gate designs taught in the Prior Art. Therefore, the flexible water gate reduces the disruption caused to ports, canal and river estuaries during initial installation and maintenance work.

Employing one or more flexible water gate 29 to produce a flexible flood control barrier 34 has several advantages over exiting flood barrier systems. This system removes the requirement for substantial civil engineering works to be carried out and the installation of concrete caissons. The flexible flood control barrier 34 is therefore significantly more cost efficient and has less of an environmental impact than existing systems.

When not in use the flexible membranes of the flexible water gates can be stored in the open position such that they are located on the riverbed. At such time they provide unrestricted access to marine vessels.

The foregoing description of the invention has been presented for purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. A flexible water gate for retaining water in a port, a canal or a river estuary comprising a unitary flexible membrane having a first surface, a second surface, a first side and a second side; a gate operating mechanism that moves the flexible membrane between a closed position and an open position, wherein the flexible membrane is lowered from the closed position to the open position, wherein in the open position the flexible membrane is stored on the bed of the port, canal or river estuary to provide unrestricted access to said port, canal or river estuary; a first recess located at the first side and a second recess located at the second side of the flexible membrane; and a first side seal and a second side seal associated with the first recess and the second recess, respectively, wherein the first and second side seals are located on the low water side of the flexible membrane such that when the flexible membrane is in the closed position a hydraulic pressure associated with a retained water acts against the first surface of the flexible membrane to maintain the second surface of the flexible membrane against the first and second side seals forming a watertight seal along each of the first and second sides of the flexible water gate; wherein the gate operating mechanism comprises a mechanical pulley system and a plurality of adjustment means and a plurality of support lines, wherein the plurality of adjustment means connect the plurality of support lines to the mechanical pulley system.

2. The flexible water gate of claim 1 wherein the plurality of support lines are connected to the mechanical pulley system and orientated in a substantially vertical plane, wherein operation of the mechanical pulley system moves the plurality of support lines within the substantially vertical plane and moves the flexible membrane from the closed position to the open position.

3. The flexible water gate of claim 1 wherein each of the plurality of adjustment means comprises a turn buckle adjustment screw and wherein the turn buckle adjustment screw allows a variable tension within the support lines.

4. The flexible water gate of claim 1 wherein the mechanical pulley system comprises a chain and a plurality of pulley wheels, wherein the chain and the plurality of pulley wheels are arranged such that the chain provides at least two substantially vertical sections and wherein the two substantially vertical sections travel with the same velocity; wherein the mechanical pulley system further comprises two or more support frames, the two or more support frames comprising a vertical post and a plurality of rollers wherein the plurality of rollers move along a length of the vertical post; and wherein the two or more support frames further comprise one or more support guys and one or more pile foundations, such that the one or more support guys connect the one or more pile foundations to a vertical post.

5. The flexible water gate of claim 1 wherein the support lines are selected from the group consisting of rope, chain, cord and straps.

6. A flexible water gate for retaining water in a port, a canal or a river estuary comprising a unitary flexible membrane having a first surface, a second surface, a first side and a second side;

a gate operating mechanism comprising a mechanical pulley system, that moves the flexible membrane between a closed position and an open position, wherein the flexible membrane is lowered from the closed position to the open position;

a first recess located at the first side and a second recess located at the second side of the flexible membrane;

a first side seal and a second side seal associated with the first recess and the second recess, respectively, wherein the first and second side seals are located on the low water side of the flexible membrane such that when the flexible membrane is in the closed position a hydraulic pressure associated with a retained water acts against the first surface of the flexible membrane to maintain the second surface of the flexible membrane against the first and second side seals forming a watertight seal along each of the first and second sides of the flexible water gate;

and a plurality of adjustment means and a plurality of support lines, wherein the plurality of adjustment means connect the plurality of support lines to the mechanical pulley system.

* * * * *